US009854833B2

(12) United States Patent
Crooks et al.

(10) Patent No.: US 9,854,833 B2
(45) Date of Patent: Jan. 2, 2018

(54) APPARATUS AND ASSOCIATED METHOD FOR FORMING A FILTER COMPONENT OF A SMOKING ARTICLE

(75) Inventors: Evon L. Crooks, Mocksville, NC (US); Balager Ademe, Winston Salem, NC (US); Calvin W. Henderson, Lewisville, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 160 days.

(21) Appl. No.: 13/398,449

(22) Filed: Feb. 16, 2012

(65) Prior Publication Data

US 2013/0213421 A1 Aug. 22, 2013

(51) Int. Cl.

| | |
|---|---|
| ***A24D 3/06*** | (2006.01) |
| ***A24D 3/02*** | (2006.01) |
| ***A24D 3/08*** | (2006.01) |
| ***D04H 3/14*** | (2012.01) |

(52) U.S. Cl.

CPC ..... *A24D 3/0204* (2013.01); *A24D 3/068* (2013.01); *A24D 3/08* (2013.01); *D04H 3/14* (2013.01)

(58) Field of Classification Search

USPC ..... 131/332; 156/73.1–73.6

See application file for complete search history.

(56) References Cited

U.S. PATENT DOCUMENTS

| | | | | |
|---|---|---|---|---|
| 3,471,901 A | | 10/1969 | Grey | |
| 3,847,064 A | * | 11/1974 | Berger | 493/44 |
| 4,435,239 A | * | 3/1984 | Harris | 156/180 |
| 4,474,190 A | | 10/1984 | Brand | |
| 4,661,090 A | | 4/1987 | Arthur | |
| 4,781,203 A | | 11/1988 | LaHue | |

(Continued)

FOREIGN PATENT DOCUMENTS

| | | |
|---|---|---|
| CN | 102788867 A | 11/2012 |
| DE | 1 294 866 | 5/1969 |

(Continued)

OTHER PUBLICATIONS

Hermann Ultrasonics; Fundamentals of Ultrasonics—The Principle of Ultrasonic Technique; http://hermannultrasonics.com/fundmentals.html; Nov. 10, 2011 (1 pg.).

(Continued)

*Primary Examiner* — Eric Yaary
(74) *Attorney, Agent, or Firm* — Womble Carlyle Sandridge & Rice, LLP

(57) ABSTRACT

Apparatuses, systems, and methods employing ultrasonic bonding to form filter elements for smoking articles are provided. Ultrasonic bonding can be employed to bond the fibers of filter material defining bloomed tow. Use of a plasticizer may not be necessary. Further, filter materials such as polylactic acid, which may not be bonded via a plasticizer, may be employed. However, triacetin or other additional components may be employed to provide the filter element with a desirable sensory attribute in some embodiments. Ultrasonic bonding may be conducted by an ultrasonic bonder that includes an anvil defining a pattern thereon that is selected to define a desired degree of bonding, and thereby a resulting desired firmness and/or pressure drop associated with the filter element.

19 Claims, 7 Drawing Sheets

(56) References Cited

U.S. PATENT DOCUMENTS

| | | | | |
|---|---|---|---|---|
| 4,844,100 | A | 7/1989 | Holznagel | |
| 5,156,169 | A | 10/1992 | Holmes | |
| 5,191,906 | A | 3/1993 | Myracle, Jr. | |
| 5,387,285 | A | 2/1995 | Rivers | |
| 5,730,351 | A | 3/1998 | Hermann | |
| 5,998,500 | A * | 12/1999 | Cahill et al. | 523/124 |
| 6,053,999 | A * | 4/2000 | Marcus | 156/73.2 |
| 6,190,296 | B1 | 2/2001 | Gnad | |
| 6,647,878 | B2 | 11/2003 | Blau | |
| 6,848,449 | B2 | 2/2005 | Kitao | |
| 6,904,917 | B2 | 6/2005 | Kitao | |
| 7,108,764 | B2 | 9/2006 | Schneider | |
| 7,210,486 | B2 | 5/2007 | Hartmann | |
| 7,234,471 | B2 | 6/2007 | Fitzgerald | |
| 7,275,548 | B2 | 10/2007 | Hancock | |
| 7,281,540 | B2 | 10/2007 | Barnes | |
| 7,959,054 | B2 | 6/2011 | Konieczka | |
| 2001/0013387 | A1 * | 8/2001 | Lorenzen | 156/73.2 |
| 2003/0188819 | A1 * | 10/2003 | Campbell et al. | 156/73.1 |
| 2009/0250170 | A1 | 10/2009 | Aust | |
| 2009/0288669 | A1 * | 11/2009 | Hutchens | 131/274 |
| 2010/0101588 | A1 | 4/2010 | Boldrini et al. | |
| 2010/0282395 | A1 | 11/2010 | Volger | |
| 2011/0042014 | A1 | 2/2011 | Vogler | |
| 2011/0083686 | A1 | 4/2011 | Yang et al. | |
| 2011/0094526 | A1 * | 4/2011 | Marshall et al. | 131/332 |
| 2011/0180084 | A1 | 7/2011 | Sebastian | |
| 2013/0029822 | A1 | 1/2013 | Iliev et al. | |

FOREIGN PATENT DOCUMENTS

| | | | |
|---|---|---|---|
| DE | 1294866 | * | 5/1969 |
| GB | 1 558 402 | | 1/1980 |
| GB | 2 267 681 | | 12/1993 |
| JP | 1142074 | | 2/1999 |
| JP | 11196843 | A | 7/1999 |
| JP | 2001516601 | A | 10/2001 |
| JP | 2011520469 | A | 7/2011 |
| JP | 2013523554 | A | 6/2013 |
| WO | 2011094171 | | 8/2011 |
| WO | 2012061192 | A1 | 5/2012 |
| WO | 2012177482 | A1 | 12/2012 |
| WO | 2012177483 | A1 | 12/2012 |

OTHER PUBLICATIONS

Hermann Ultrasonics; Nonwovens—High Process Speed and Consistent Quality for Nonwovens; http://hermannultrasonics.com/nonwovens.html; Nov. 10, 2011 (2 pgs.).

International Search Report and Written Opinion of the International Searching Authority for corresponding International Application No. PCT/US2013/026103 mailed Aug. 9, 2013.

Second Written Opinion of the International Searching Authority for corresponding International Application No. PCT/US2013/026103 mailed Jan. 24, 2014.

* cited by examiner

APPARATUS AND ASSOCIATED METHOD FOR FORMING A FILTER COMPONENT OF A SMOKING ARTICLE

BACKGROUND OF THE DISCLOSURE

Field of the Disclosure

The present disclosure relates to products made or derived from tobacco, or that otherwise incorporate tobacco, and are intended for human consumption. In this regard, aspects of the present disclosure relate to smoking articles, and, more particularly, to apparatuses and associated methods for forming a filter element of a smoking article, such as a cigarette.

Description of Related Art

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments. In some instances, one of those segments can comprise activated charcoal particles. Typically, the filter element is attached to one end of the tobacco rod using a circumscribing material known as "tipping paper" or "tipping material." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Although the above-described embodiments of filter elements may function properly, it can be desirable, for example, to produce components of the filter elements from biodegradable materials. Further, it may be desirable to retain the sensory attributes (e.g., taste and/or smell) associated with cellulose acetate plasticized by triacetin. Accordingly, it may be desirable to facilitate the manufacture of such biodegradable flavored cigarettes, in a rapid, highly-automated fashion. As such, there exists a need for apparatuses and methods capable of producing biodegradable filter elements that may retain desirable sensory attributes.

BRIEF SUMMARY OF THE DISCLOSURE

In one aspect, a method for forming a filter element for a smoking article is provided. The method may comprise blooming a tow including a plurality of fibers of a filter material to define a bloomed tow and ultrasonically bonding the fibers of the filter material defining the bloomed tow to form a bonded bloomed tow.

In one embodiment the method may further comprise wrapping the bonded bloomed tow with a plug wrap. The method may also include applying a plasticizer to the bonded bloomed tow. Applying a plasticizer may comprise applying triacetin to the bonded bloomed tow. Blooming a tow may comprise blooming a tow including a plurality of fibers of one of polylactic acid and cellulose acetate.

Ultrasonically bonding the fibers of the filter material may comprise vibrating the fibers of the filter material at a frequency of between about 20 kilohertz and about 35 kilohertz and/or vibrating the fibers of the filter material at a peak power level of between about 600 watts and about 4,000 watts. Additionally, ultrasonically bonding the fibers of the filter material may comprise directing the bloomed tow between a sonotrode and an anvil thus generating enough heat to bond the fibers together. Ultrasonically bonding the strands of the filter material may also comprise ultrasonically bonding the strands of the filter material defining the bloomed tow in a pattern configured to bond the fibers to a degree that defines a selected pressure drop between opposing ends of the filter element. The degree of bonding also determines the firmness of the resulting filter rod.

In another aspect a filter element for a smoking article is provided. The filter element may comprise a plurality of fibers of a filter material bloomed to define a bloomed tow and ultrasonically bonded to form a bonded bloomed tow.

In one embodiment the filter element may further comprise a plasticizer, such as triacetin. The filter element may define a firmness from about 1% to about 10%. The filter material may comprise one of cellulose acetate and polylactic acid. Additionally, the fibers of the filter material defining the bloomed tow may be ultrasonically bonded in a pattern configured to bond the fibers to a degree that defines a selected pressure drop between opposing ends of the filter element.

In another aspect, a tobacco product is provided. The tobacco product may comprise a tobacco material, a filter element, and a tipping material extending at least partially about the tobacco material and the filter element. The filter element may comprise a plurality of fibers of a filter material bloomed to define a bloomed tow and ultrasonically bonded to form a bonded bloomed tow.

In one embodiment the tobacco product may further comprise a wrapping material extending at least partially about the tobacco material. The tobacco product may further comprise a plug wrap extending at least partially about the bonded bloomed tow. The tobacco product may also include a plasticizer such as triacetin. The filter material may comprise polylactic acid. The fibers of the filter material defining the bloomed tow are bonded in a pattern configured to bond the fibers to a degree that defines a selected pressure drop between opposing ends of the filter element.

In another aspect, an apparatus configured to form a filter element for a smoking article is provided. The apparatus may comprise a tow spreader configured to bloom a plurality of fibers of a filter material to define a bloomed tow, and an ultrasonic bonder configured to ultrasonically bond the bloomed plurality of fibers of the filter material defining the bloomed tow to form a bonded bloomed tow.

In one embodiment the apparatus may further comprise a rod maker configured to wrap the bonded bloomed tow with a plug wrap. The ultrasonic bonder may comprise a sonotrode and an anvil, wherein the sonotrode and the anvil define a nip configured to receive the bloomed tow therebetween. The anvil may define a patterned outer surface configured to bond the fibers of the filter material defining the bloomed tow in a pattern configured to define a selected pressure drop between opposed ends of the filter element. The sonotrode may be configured to vibrate at a frequency of between about 20 kilohertz and about 35 kilohertz. The ultrasonic bonder may be configured to vibrate at a peak power level of between about 600 watts and about 4,000 watts.

Aspects of the present disclosure thus address the identified needs and provide other advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 2:
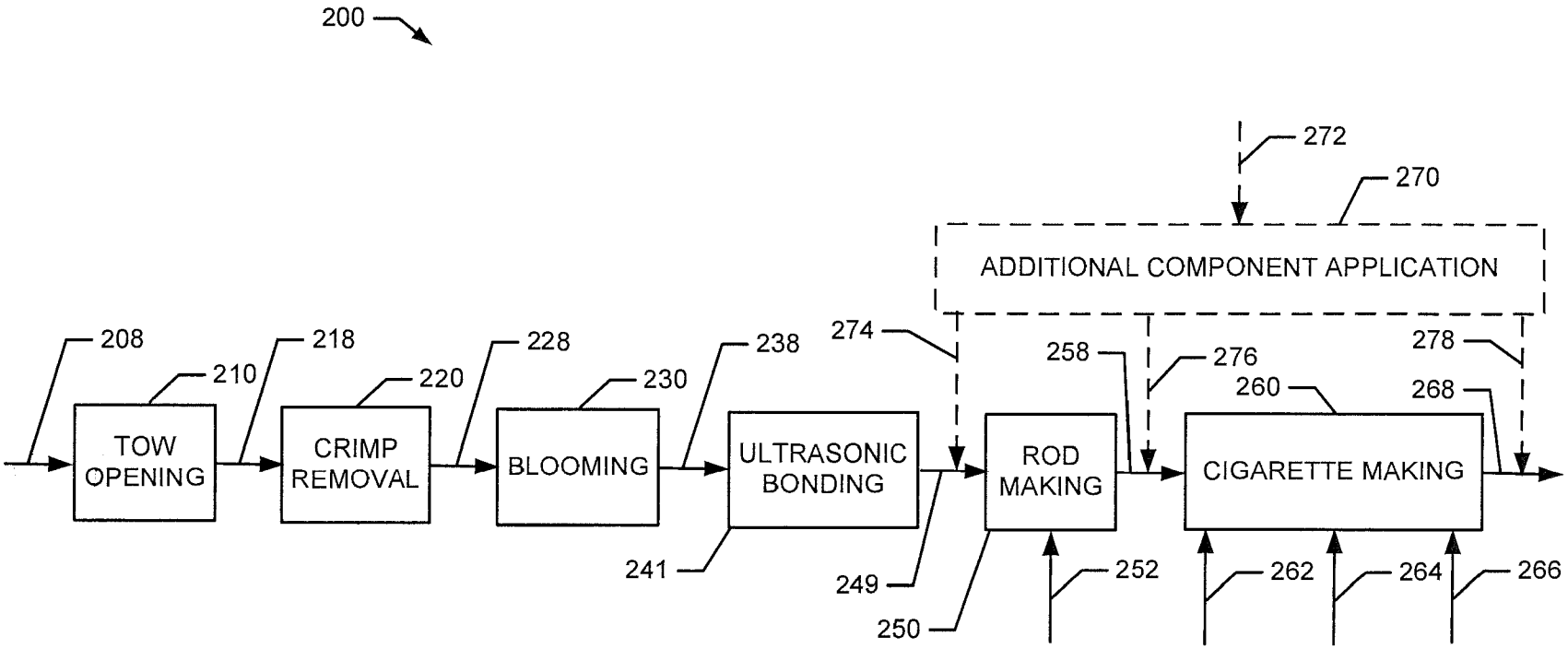
FIG. 2 illustrates a block diagram of a system of operations, including ultrasonic bonding, configured to produce cigarettes, according to an example embodiment of the present disclosure.
Figure 3:
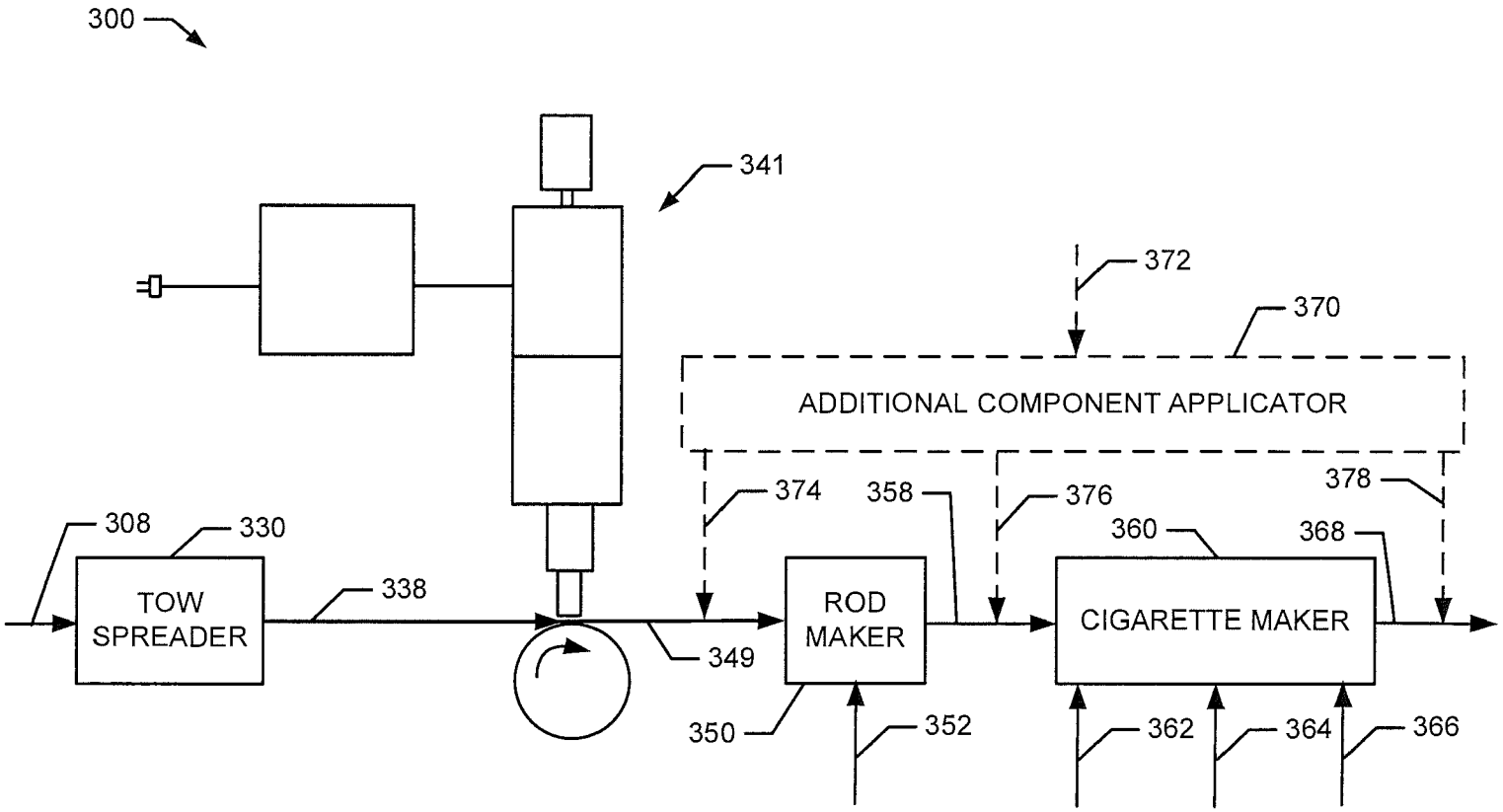
Figure 4:
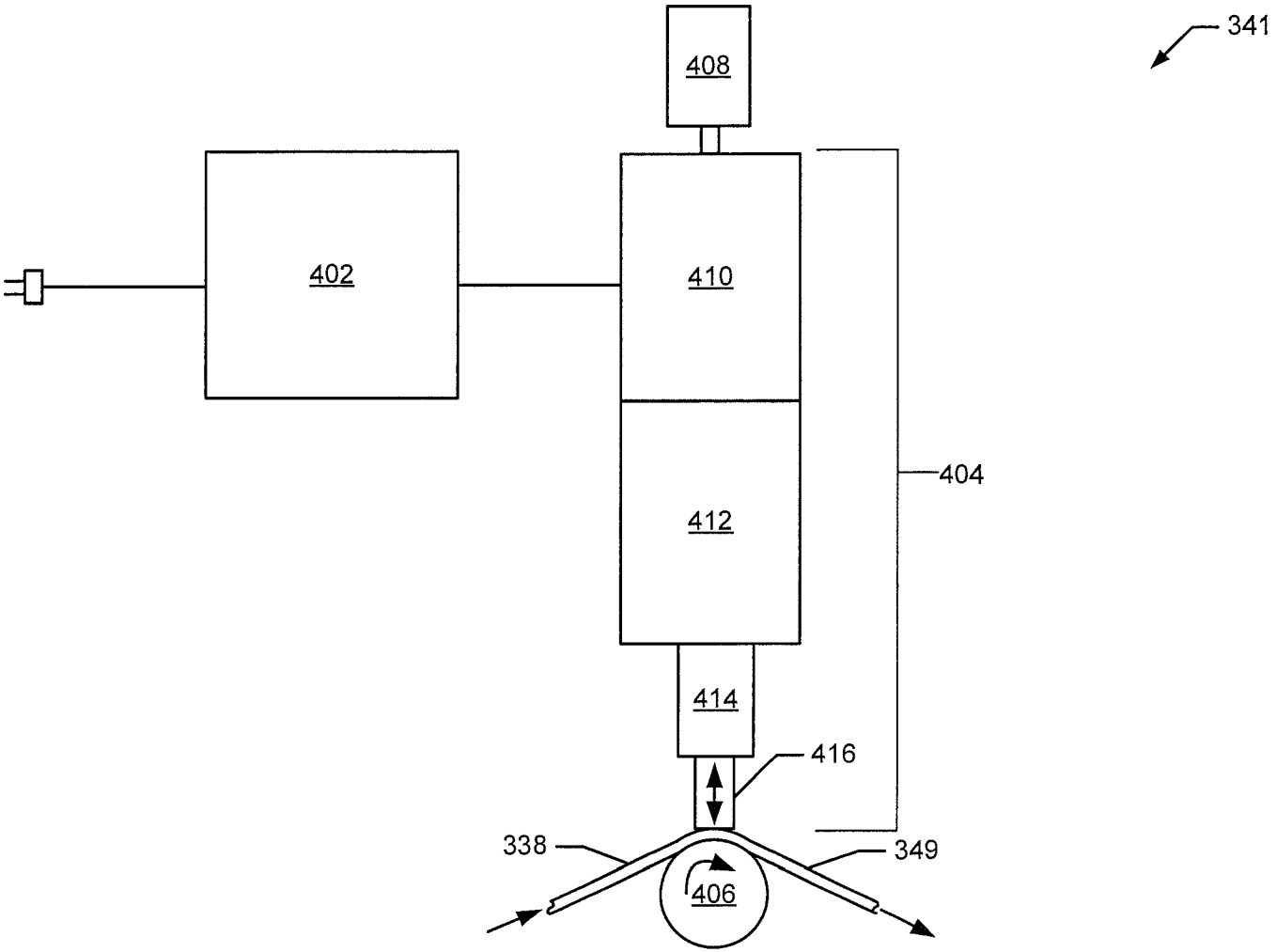
Figure 5:
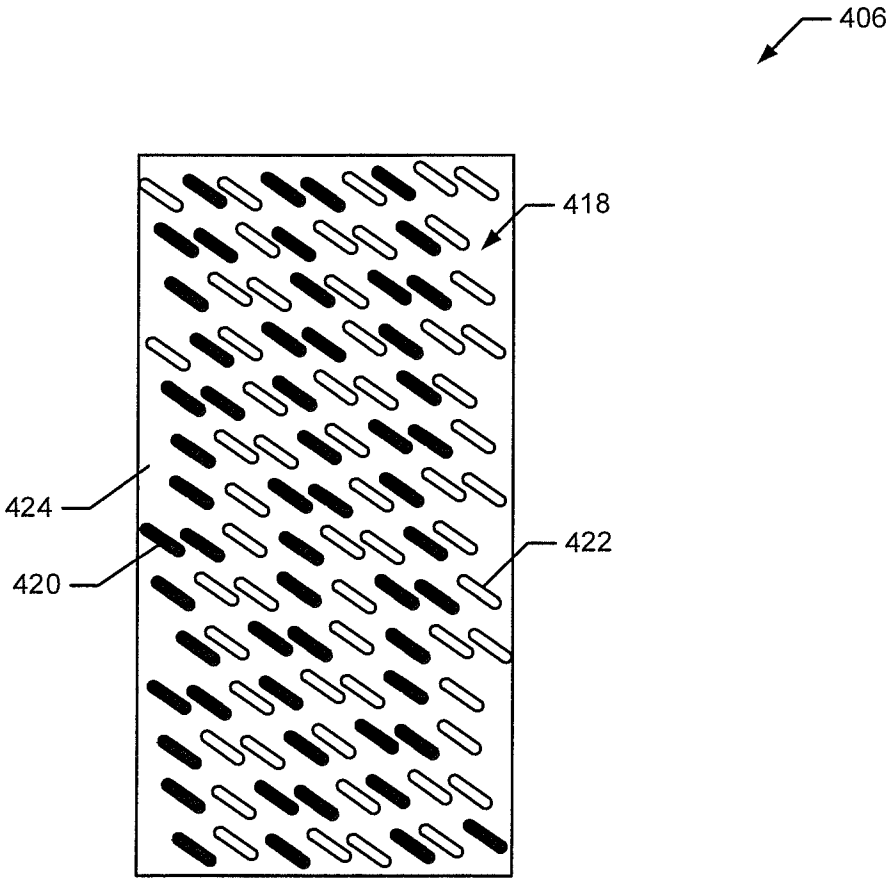
Figure 6:
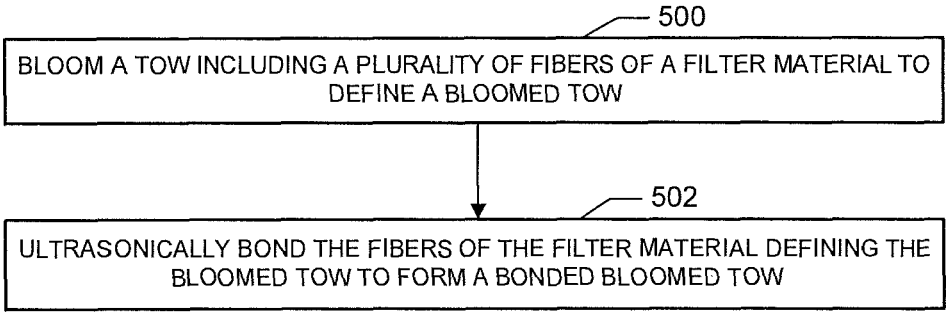
Figure 7:
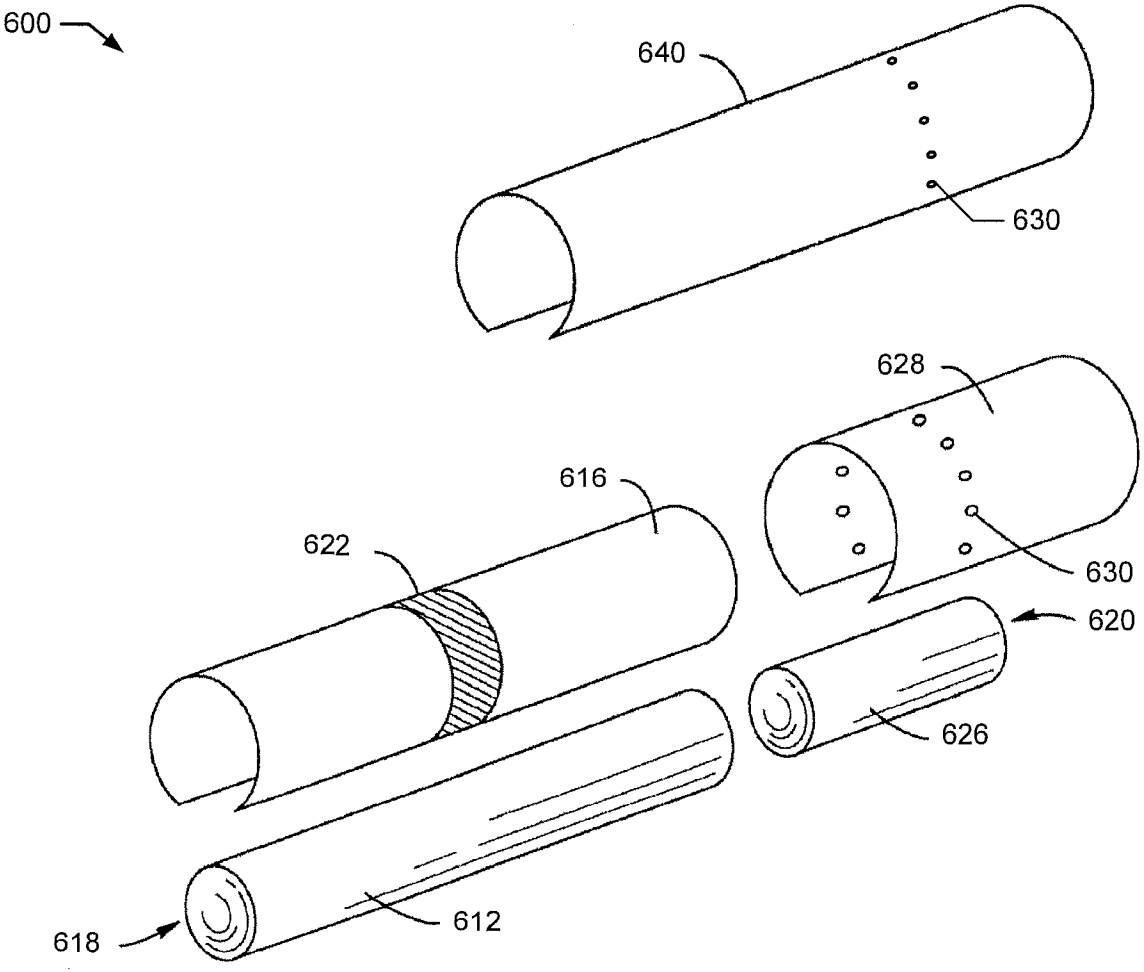

FIG. 3 schematically illustrates a system of apparatuses, including an ultrasonic bonder, configured to perform the operations provided in FIG. 2, according to an example embodiment of the present disclosure;

FIG. 4 schematically illustrates the ultrasonic bonder included in the system of FIG. 3, according to an example embodiment of the present disclosure;

FIG. 5 illustrates a top view of a roller of the ultrasonic bonder of FIGS. 2 and 3, according to an example embodiment of the present disclosure;

FIG. 6 illustrates a method for forming a filter element, according to an example embodiment of the present disclosure; and FIG. 7 illustrates an exploded view of a smoking article, according to an example embodiment of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure can be embodied in many different forms and should not be construed as limited to the aspects set forth herein; rather, these aspects are provided so that this disclosure will satisfy applicable legal requirements Like numbers refer to like elements throughout.

As described herein, embodiments of the disclosure relate to filter elements formed from ultrasonically bonded tow. Further, the present disclosure also relates to method and apparatuses for the production of filter elements formed from ultrasonically bonded tow. By way of comparison, in the traditional production of cigarettes, filter tow is typically bonded using a plasticizer.

Tow fiber can be produced, in one example embodiment, by spinning a dope, which can comprise a solution of a polymer (e.g., cellulose acetate) and a solvent (e.g., acetone), into a plurality of filaments. The filaments can be taken up, lubricated, and formed into a tow fiber by bundling the filaments. The tow fiber can then be crimped in order to increase the volume of the tow fiber. Further, the tow fiber can be dried and bailed for shipment to a filter element manufacturer.

Figure 1:
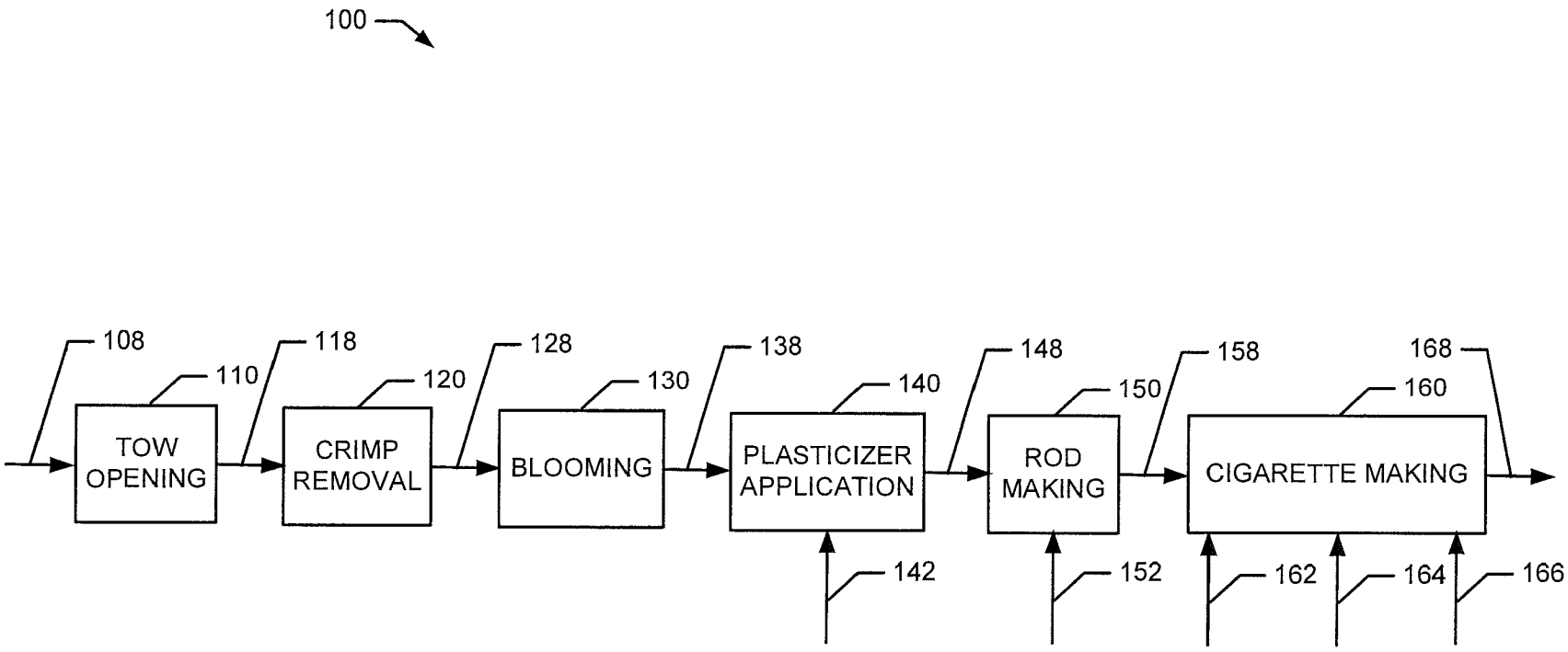
FIG. 1 (Prior Art)
FIG. 1 illustrates a block diagram of a prior art system of operations configured to produce cigarettes.

In this regard, FIG. 1 illustrates an example embodiment of a prior art system 100 of operations configured to produce cigarettes or other smoking articles, in which operations performed by the system are illustrated schematically. As illustrated, the system 100 can receive as an input a tow fiber 108, which can be produced according to the above-described manufacturing process or various other manufacturing processes. The tow fiber 108 can be subjected to a tow opening at operation 110. Tow opening refers to one or more processes whereby the tow fiber 108 is spread out. In this regard, the tow fiber 108 can be initially packaged in a bale or packaged in another manner whereby each filament forming the tow fiber is substantially in continuous contact with those filaments adjacent thereto. In one embodiment, tow opening at operation 110 can be conducted by a pneumatic banding jet that flattens and spreads the tow fiber 108 and forms a spread tow 118. However, various other techniques can be employed in other embodiments to produce the spread tow 118.

The system 100 can be further configured to conduct crimp removal on the spread tow 118 at operation 120. Crimp removal at operation 120 can involve stretching the spread tow fiber 118 to form a decrimped tow 128. Crimp removal can be conducted by directing the spread tow 118 through one or more cooperating sets of rollers with circumferential grooves in some embodiments.

The decrimped tow 128 can be subjected to blooming at operation 130. Blooming can involve introducing further separation between the filaments defining the tow. Blooming at operation 130 can be conducted through a variety of techniques, such as tensioning and relaxing alternating sections of the tow using rollers. Alternatively or additionally, one or more pneumatic banding jets can be employed to bloom the tow.

In this regard, the tow opening, crimp removal, and blooming operations 110, 120, 130 all refer to operations whereby the filaments defusing the tow fiber 108 are at least partially separated from one another. Separating the filaments defining the tow fiber 108 in this manner ultimately produces a bloomed tow 138. Thus, the term "bloomed tow," as used herein refers to tow fibers that have been at least partially separated through one or more of the tow opening, crimp removal, and blooming operations 110, 120, 130. In some embodiments the tow opening, crimp removal, and blooming operations 110, 120, 130 can be conducted at differing times and/or separate equipment may be employed to perform these operations. However, in other embodiments the tow opening, crimp removal, and/or blooming operations 110, 120, 130 can occur substantially simultaneously and/or involve use of the same equipment in some embodiments. For example, tow opening at operation 110 and blooming at operation 130 can both occur via use of one or more pneumatic banding jets. Alternatively, or additionally, crimp removal at operation 120 and blooming at operation 130 can both occur via use of grooved rollers.

Thus, while the tow opening, crimp removal, and blooming operations 110, 120, 130 are illustrated and generally described above as being separate operations, it should be understood that there can be overlap between one or more of these operations, or one or more of these operations can be omitted. In this regard, the term "tow separation," as used herein, can refer to one or more of the tow opening, crimp removal and blooming operations 110, 120, 130, which results in bloomed tow 138, as defined above.

The system 100 can subject the bloomed tow 138 to plasticizer application at operation 140. Plasticizer application can involve applying (e.g., via spraying or wick application) a plasticizer 142 to the bloomed tow 138 to produce a plasticized fiber product 148. Plasticizer application at operation 140 can be conducted for the purpose of ultimately bonding the parallel aligned filaments of the tow to one another to produce a relatively firm and rigid structure configured to not soften or collapse during smoking. The tow separation operations described above are configured to improve the penetration of the plasticizer 142 by creating gaps between the filaments defining the bloomed tow 138 through which the plasticizer can travel.

The plasticizer 142, which can in some embodiments comprise triacetin and/or carbowax, can be applied to the bloomed tow 138 in traditional amounts using known techniques. In one embodiment, the plasticizer 142 can comprise triacetin and carbowax in a 1:1 ratio by weight. The total amount of plasticizer 142 can be generally about 4 to about 20 percent by weight, preferably about 6 to about 12 percent by weight of the filter material. Other suitable materials used in connection with the construction of the filter element will be readily apparent to those skilled in the art of cigarette filter design and manufacture. See, for example, U.S. Pat. No. 5,387,285 to Rivers, which is incorporated herein by reference.

The plasticized fiber product 148 can then be subjected to one or more rod making operations 150. Rod making operations 150 can include shaping of the plasticized fiber product 148. For example, the plasticized fiber product 148 can be compressed or otherwise shaped to form a continuous cylindrical rod shape.

The rod making operations 150 can additionally include cutting the plasticized fiber product 148 into segments. In this regard, the plasticized fiber product 148 can be longitudinally subdivided into cylindrical shaped filter segments. In some embodiments the length of the filter segments can be selected based on a desired length of the filter element for a single cigarette. By way of further example, in another embodiment the filter segments can be cut to lengths which are equivalent to two times the length of the filter element for a single cigarette, and the filter segment can be cut in two at a later time. For example, the filter segment can connect two rods of tobacco, and the filter segment can be divided to form the filters for two cigarettes.

The measurements of filter segments depend on the particular application thereof, but typically filter segments for cigarettes can range in length from about 80 mm to about 140 mm, and from about 16 mm to about 27 mm in circumference. For example, a typical filter segment having a 100 mm length and a 24.53 mm circumference can exhibit a pressure drop of from about 200 mm to about 400 mm of water as determined at an airflow rate of 17.5 cubic centimeters per second (cc/sec.) using an encapsulated pressure drop tester, sold commercially as Model No. FTS-300 by Filtrona Corporation, Richmond, Va.

Rod making at operation 150 can also include wrapping the plasticized fiber product 148 with a plug wrap 152 in some embodiments. The plasticized fiber product 148 can be wrapped with the plug wrap 152 such that each end of the filter material remains exposed. The plug wrap 152 can vary. See, for example, U.S. Pat. No. 4,174,719 to Martin. Typically, the plug wrap 152 is a porous or non-porous paper material. Suitable plug wrap materials are commercially available. Exemplary plug wrap papers ranging in porosity from about 1100 CORESTA units to about 26000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the plasticized fiber product 148, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

If desired, so-called "non-wrapped acetate" filter segments can also be produced. Such segments are produced using the types of techniques generally set forth herein. However, rather than employing a plug wrap that circumscribes the longitudinally extending periphery of the filter material, a somewhat rigid rod is provided, for example, by applying steam to the shaped plasticized fiber product 148. Techniques for commercially manufacturing non-wrapped acetate filter rods are possessed by Filtrona Corporation, Richmond, Va.

Accordingly, shaped, cut, and/or wrapped (or non-wrapped) filter elements 158 can be produced by the rod making operation(s) 150. The system 100 can further conduct cigarette making operations 160. The cigarette making operations 160 can include wrapping a supply of smokable material 162 with wrapping material 164 to form a smokable rod.

Further, the cigarette making operations 160 can include attaching the filter element 158 to the smokable rod. For example, the filter element 158 and a portion of the smokable rod can be circumscribed by a tipping material 166 with an adhesive configured to bind to the filter element and the tobacco rod so as to couple the filter element to an end of the tobacco rod.

Accordingly, cigarettes 168 (or other smokable articles) can be produced in accordance with the above-described example embodiments, or under various other embodiments of systems and methods for producing cigarettes. As described above, known manufacturing methods and apparatuses conventionally employ a plasticizer to bond the tow in the formation of the filter element. However, it can be desirable to bond tow without necessarily employing a plasticizer.

In this regard, FIG. 2 illustrates an embodiment of a system 200 of operations configured to produce cigarettes or other smoking articles according to an example embodiment of the present disclosure, with operations performed by the system illustrated schematically. As illustrated, the system 200 can receive as an input a tow fiber 208, which can be produced according to the above-described manufacturing process or various other manufacturing processes. In this regard, by way of example, the tow fiber 208 may comprise cellulose acetate (e.g., cellulose acetate with polymers) in one embodiment. By way of one additional example embodiment, the tow fiber 208 may comprise polylactic acid. Other types of filter materials, such as paper, nonwoven polypropylene or polyolefin web or gathered fibers of shredded web, can be employed as set forth in U.S. Pat. No. 3,805,682 to Lyon et al.; U.S. Pat. No. 4,763,674 to Lelah; U.S. Pat. No. 4,807,809 to Pryor et al.; U.S. Pat. No. 4,811,745 to Cohen et al.; U.S. Pat. No. 4,903,714 to Barnes et al.; U.S. Pat. No. 4,925,602 to Hill et al.; U.S. Pat. No. 5,025,814 to Raker; U.S. Pat. No. 5,101,839 to Jakob et al.; U.S. Pat. No. 5,246,017 to Saintsing et al.; U.S. Pat. No.

5,271,419 to Arzonico et al.; U.S. Pat. No. 5,360,023 to Blakely et al.; U.S. Pat. No. 5,404,890 to Gentry et al.; and U.S. Pat. No. 5,568,819 to Gentry et al.

Although the system 200 can differ in some embodiments, the system 200 of FIG. 2 can include some operations that are substantially similar to those described above with respect the system 100 of FIG. 1. For example, the system can conduct tow opening at operation 210 to form a spread tow 218. The system 200 can be further configured to conduct crimp removal on the spread tow 218 at operation 220. The resulting decrimped tow 228 can be subjected to blooming at operation 230 to produce a bloomed tow 238.

The bloomed tow 238 can then be bonded. In the system illustrated in FIG. 1, as noted above, bonding is conducted via plasticizer application at operation 140. However, in the system 200 illustrated in FIG. 2, bonding of the bloomed tow 238 can be conducted by ultrasonic bonding at operation 241. In this regard, embodiments of the present disclosure need not necessarily employ a plasticizer. However, a plasticizer can be employed in other embodiments, as discussed below.

Ultrasonic bonding refers to use of ultrasound to couple two or more items. Ultrasound is a mechanical vibration above the audible limit, which begins at about 15 kilohertz (kHz). The ultrasonic vibrations can be employed to couple two items by melting one or both of the two items at the point of contact therebetween (i.e., by friction), thereby creating a joint as the melted item(s) fuse together. Accordingly, ultrasonic bonding at operation 241 can comprise ultrasonically bonding the fibers of the filter material defining the bloomed tow 238 to form a bonded bloomed tow 249. Note that the term "fiber," as used herein, refers to any strands, filaments, and various other embodiments of suitable filiform elements of material.

Ultrasonic bonding at operation 241 can provide benefits relative to use of a plasticizer to bond the bloomed tow 238. In this regard, ultrasonic bonding can be employed to bond materials which may not be bondable via application of a plasticizer. For example, polylactic acid is a thermoplastic aliphatic polyester derived from renewable resources, such as corn starch, tapioca products or sugarcanes, which can biodegrade under certain conditions, such as the presence of oxygen.

Although Applicant has identified benefits associated with use of polylactic acid as filter tow, Applicant is unaware of a suitable plasticizer for use in bonding polylactic acid. However, Applicant has determined that polylactic acid can be bonded ultrasonically. Accordingly, use of ultrasonic bonding at operation 241 can allow for use of filter materials such as polylactic acid that are not traditionally employed in filter elements for smoking articles.

After undergoing ultrasonic bonding at operation 241, the bonded bloomed tow 249 can then be subjected to one or more rod making operations 250. Rod making operations 250 can include shaping of the bonded bloomed tow 249. For example, the bonded bloomed tow 249 can be compressed or otherwise shaped to form a continuous cylindrical rod shape. Further, the rod making operation(s) 250 can include cutting the bonded bloomed tow 249 into segments. Rod making at operation 250 can also include wrapping the bonded bloomed tow with a plug wrap 252 in some embodiments. However, in other embodiments, the filter segments can remain unwrapped. For example, the bonded bloomed tow 249 produced by ultrasonic bonding at operation 241 can be sufficiently strengthened to define a rigid rod suitable for use as a filter element. Alternatively, the bonded bloomed tow 249 can be strengthened, for example, by applying steam thereto.

Accordingly, shaped, cut, and/or wrapped (or non-wrapped) filter elements 258 can be produced by the rod making operation(s) 250. The system 200 can further conduct cigarette making operations 260. The cigarette making operations 260 can include wrapping a supply of smokable material 262 with wrapping material 264 to form a smokable rod. Further, the cigarette making operations 260 can include attaching the filter element 258 to the smokable rod. For example, the filter element 258 and a portion of the smokable rod can be circumscribed by a tipping material 266 with an adhesive configured to bind to the filter element and the smokable rod so as to couple the filter element to an end of the smokable rod. Accordingly, cigarettes 268 (or other smokable articles) can be produced in accordance with the above-described example embodiments, or under various other embodiments of systems and methods for producing cigarettes.

Thus, embodiments of the system 200 of FIG. 2 can differ from the embodiment of the system 100 illustrated in FIG. 1 at least in that the bloomed tow 238 is bonded ultrasonically. Further, as illustrated at operation 270 the system can also be configured to conduct application of an additional component 272, which can be applied to one of more of the materials employed in forming the cigarettes 268.

The additional component 272 can contribute some functionality or property to the formed filter rod portion, such as, for example, smoke filtering, smoke taste, water dispersibility, biodegradability, and/or compostability. For example, the additional component 272 can comprise a flavoring compound, propylene glycol, tri-ethyl-citrate, or any other suitable substance. In one embodiment the additional component can comprise a plasticizer such as triacetin and/or carbowax which are normally applied to plasticize cellulose acetate, as described above with respect to the system 100 illustrated in FIG. 1. In this regard, a plasticizer can be employed as the additional component 272 to provide the resulting cigarettes 268 with a desirable taste. For example, although triacetin may not suitably bond polylactic acid, triacetin can be applied as the additional component 272 in order to provide the resulting cigarettes 268 with a desirable taste associated with triacetin.

Operation 270 can apply the additional component 272 at one or more points relative to the other operations conducted by the system 200. For example, as illustrated at arrow 274, in one embodiment the additional ingredient 272 can be applied to the bonded bloomed tow 249 after ultrasonic bonding at operation 241 and before rod making at operation 250. In another embodiment the additional ingredient 272 can be applied to the filter element 258 after rod making at operation 250 and before cigarette making at operation 260, as illustrated at arrow 276. For example, the additional ingredient 272 can be applied to either end of each segment of the filter element 258. In an additional embodiment the additional ingredient 272 can be applied to the cigarettes 268 after cigarette making at operation 260, as illustrated at arrow 278. For example, the additional ingredient 272 can be applied to the exposed ends of the cigarettes 268 at the filter element. However, it should be understood that the additional ingredient can be applied at other times (e.g., prior to ultrasonic bonding at operation 241), and the above-described embodiments are provided for example purposes only.

An example embodiment of a system 300 for forming cigarettes is illustrated in FIG. 3, with apparatuses forming the system illustrated schematically. In this regard, the system 300 can include a tow spreader 330 configured to receive a tow fiber 308 and produce a bloomed tow 338. The tow spreader 330 can perform one or more operations such as tow opening 210, crimp removal 220, and blooming 230, as described above with respect to FIG. 2.

For example, filter tow can be bloomed using bussel jet methodologies or threaded roll methodologies in the tow spreader 330. An exemplary tow spreader 330 has been commercially available as E-60 supplied by Arjay Equipment Corp., Winston-Salem, N.C. Other exemplary pieces of equipment suitable for use as the tow spreader 330 have been commercially available as AF-2, AF-3 and AF-4 from Hauni-Werke Korber & Co. KG. and as Candor-ITM Tow Processor from International Tobacco Machinery. Other types of commercially available tow spreaders, as are known to those of ordinary skill in the art, can be employed.

The system for forming cigarettes 300 can also include other apparatuses and components that correspond with the operations discussed above in relation to FIG. 2. In this regard, the bloomed tow 338 exiting the tow spreader 330 can enter an ultrasonic bonder 341. The ultrasonic bonder 341 can be configured to ultrasonically bond the fibers of the filter material defining the bloomed tow 338, as described above at operation 241 in FIG. 2. Thus, the ultrasonic bonder 341 can produce a bonded bloomed tow 349.

An example embodiment of the ultrasonic bonder 341 is illustrated in FIG. 4. As illustrated, the ultrasonic bonder 341 can comprise a plurality of components including, for example, an ultrasonic generator 402, an ultrasonic stack 404, an anvil 406, and a press 408. The ultrasonic generator 402 can be connected to alternating current and configured to convert the frequency of the alternating current (e.g., about 50 Hz or about 60 Hz) to a higher frequency that matches a resonant frequency of the ultrasonic stack 404 (e.g., from about 15 kHz to about 70 kHz, from about 20 kHz to about 50 kHz, from about 20 kHz to about 35 kHz, about 20 kHz, about 30 kHz, about 35 kHz or about 40 kHz). Further, the ultrasonic bonder 341 can be configured to vibrate at a peak power level, for example, from about 400 watts to about 4,200 watts, from about 600 watts to about 4,000 watts, at least about 400 watts, at least about 600 watts, or less than about 4,500 watts. The peak power level of the ultrasonic generator 341 may be configured to result in a desired degree of bonding of the bloomed tow 338.

The ultrasonic stack 404 of the ultrasonic bonder 341 can comprise a plurality of components including a converter 410, a booster 412, a sonotrode (or "horn") 414, and a sonotrode tip 416. The converter 410 can be configured to convert the alternating current received from the ultrasonic generator 402 into a mechanical vibration. In one embodiment the converter 410 can comprise piezoelectric sound transducers. The booster 412 can be configured to modify the amplitude of the vibrations produced by the converter 410. For example, the booster 412 may increase the amplitude of the vibrations produced by the converter 410. Further, the sonotrode 414 applies the vibration to the spread tow through the sonotrode tip 416. In particular, the press 408 can apply pressure to the ultrasonic stack 404 such that the bloomed tow 338 is directed between the sonotrode tip 416 and the anvil 406. Accordingly, vibrations produced by the ultrasonic stack 404 can be transmitted into the bloomed tow 238 as it passes through the nip defined between the sonotrode tip 416 and the anvil 406. In some embodiments the anvil 406 may comprise a roller, whereas in other embodiments the anvil may be substantially stationary. In this regard, the term "anvil," as used herein, refers to any solid member, backing, or other suitable component configured to cooperate with the sonotrode to perform ultrasonic bonding.

Thus, the ultrasonic bonder 341 vibrates the fibers of filter material defining the bloomed tow 338 and the friction therebetween causes the fibers of filter material to heat and fuse together to form the bonded bloomed tow 349. However, since the filter material is ultimately employed in a filter element, it may be desirable to only partially bond the fibers of filter material together. In this regard, the anvil 406 and/or the sonotrode tip 416 can be configured to bond the fibers of filter material in a pattern, rather than continuously bonding the fibers of filter material.

By way of example, FIG. 5 illustrates a top view of the anvil 406. As illustrated, the anvil 406 can define a patterned outer surface 418. The patterned outer surface 418 can define recesses 420, protrusions 422, and/or a major surface 424. The protrusions 420 can be configured to cause the fibers of filter material to bond at the locations along the length of the bloomed tow 338 at which the protrusions contact the bloomed tow. The major surface 424 can be configured to cause a decreased amount of bonding of the fibers of filter material (relative to the protrusions 420) at the points along the length of the bloomed tow 338 at which the major surface comes into contact therewith. Further, the recesses 420 can be configured to substantially avoid bonding the fibers of filter material at the points along the length of the bloomed tow 338 at which the recesses become proximate therewith. However, each of these elements need not be included in all embodiments. For example, the recesses 420 or the protrusions 422 can be omitted in some embodiments. Further, as noted above, in some embodiments the sonotrode tip 416 can additionally or alternatively define a pattern at an outer surface thereof.

Example embodiments of ultrasonic bonders and related equipment which may be employed in conjunction with embodiments of the present disclosure are described in U.S. Patent App. Pub. No. 2009/0250170 to Aust, U.S. Patent App. Pub. No. 2010/0282395 to Volger et al., U.S. Pat. No. 6,190,296 to Gnad et al., U.S. Patent App. Pub. No. 2011/0042014 to Vogler, U.S. Pat. No. 7,108,764 to Schneider, U.S. Pat. No. 7,959,054 to Konieczka, and U.S. Pat. No. 5,730,351 to Hermann, which are incorporated herein by reference. By way of further example, additional ultrasonic bonders that may be employed in accordance with embodiments of the present disclosure are available from Hermann Ultrasonics, Inc. of Bartlett, Ill.

Accordingly, the ultrasonic bonder 341 can produce a bonded bloomed tow 349 from the bloomed tow 338. Returning to FIG. 3, the system 300 can further include a rod maker 350 that receives the bonded bloomed tow 349 and wraps it with a plug wrap 352 to form a filter element 358. Example embodiments of the rod maker 350 include the KDF-2 and KDF-3E from Hauni-Werke Korber & Co. KG; and as Polaris-ITM Filter Maker from International Tobacco Machinery.

As noted above, the ultrasonic bonder 341 may be configured to precisely control the bonding of the bloomed tow 338. In this regard, the frequency of vibration, peak power of the vibrations, and pressure applied to the bloomed tow 388 may all be adjusted in addition to the bonding pattern defined by the anvil 406. Accordingly, the bonded bloomed tow 349 may be relatively precisely bonded to a desired extent and in a desired pattern. The pattern and extent (e.g., depth) of bonding produced by the ultrasonic bonder 341 can be configured to bond the fibers of the bloomed tow 349 to a degree that defines a desired pressure drop across the filter element 358 (i.e., between the opposed longitudinal ends) produced from the bonded bloomed tow 349. In this regard, for example, a filter segment having a 100 mm length and a 24.53 mm circumference can be configured to define a pressure drop of from about 100 mm to about 500 mm of water, from about 200 mm to about 400 mm of water, or from about 250 mm to about 350 mm as determined at an airflow rate of 17.5 cubic centimeters per second (cc/sec.) using an encapsulated pressure drop tester, sold commercially as Model No. FTS-300 by Filtrona Corporation, Richmond, Va. In one embodiment a desired pressure drop can be achieved by empirically testing a variety of bonding patterns (e.g. by testing a variety of anvils 406 and/or the sonotrode tips 416). In other embodiments, a bonding pattern can be selected based on a calculated pressure drop associated with the bonding pattern. Further, the bonded bloomed tow 349 can define a desired firmness. In this regard, in some embodiments the bonded bloomed tow 349 may define a firmness from about 1% to about 10%. Firmness, or hardness, is a measure of the compressibility of the filter rod and impacts the ability to tip the filter to the tobacco column. As many manufacturers move toward automatic transfer of filters to the cigarette makers, firmness is of increasing concern. By achieving a desired firmness, issues with respect to the filter element 358 collapsing when exposed to suction during use or experiencing damage in normal handling may be avoided. Filter firmness also affects many of the sensory aspects of the finished cigarette.

Firmness may otherwise be impacted by a variety of filter parameters including: the properties of the tow (e.g., denier per filament (dpf) and total denier), circumference of the filter, relative tow weight or density, and the amount (if any) of plasticizer employed. In filter rods employing plasticizer, firmness is also impacted by the amount of time that the plasticized rods have cured. After production, the rod firmness increases relatively rapidly initially, then more and more gradually until fully cured at 24 to 48 hours. Firmness testing is generally conducted on fully cured filter rods.

Firmness can be measured using a variety of test instruments. However, in all cases the principle is the same; the filter's resistance to compression or crushing is being measured under a given load. Firmness is generally expressed as the percent of deformation and can be calculated from the amount of filter depression (i.e., change in diameter) and the original diameter using Equation 1:

$$\text{Firmness}(\%) = \frac{[\text{Original diameter (mm)} - \text{Depression (mm)}] \times 100}{\text{Original diameter (mm)}} \quad \text{Equation 1}$$

The actual load applied, the method by which it is applied (e.g., by gravity or by action of the tester), and the length of contact time depends on the instrument being used. Because of these differences, firmness measurement units quoted are generally associated with a particular test method or test equipment. Results tested on different types of equipment may not be interchangeable. One example of a suitable hardness tester is manufactured by Filtrona.

By employing the ultrasonic bonder 341 to bond the fibers of filter material in the bloomed tow 338, the resulting bonded bloomed tow 349 can define a consistent pattern of bonding, as described above. Accordingly, the resulting filter element 358 can be precisely configured to define a desired pressure drop and firmness. In contrast, it can be more difficult to control the pressure drop associated with filter elements formed via plasticizer application. In this regard, plasticizers are typically applied as a fluid, and hence the amount of fluid that attaches to the bloomed tow, the penetration within the bloomed tow, and other factors can make it relatively difficult to produce filter elements defining a consistent pressure drop. In contrast, the ultrasonic bonder 341 can produce a bonded bloomed tow 358 defining a relatively consistent pattern of bonding, and accordingly, the pressure drop and firmness defined by the filter elements 358 produced therefrom can be relatively more consistent. In this regard, embodiments of the present disclosure can provide benefits not only in terms of the ability to bond tows for which suitable plasticizers are not known, but also in terms of the ability to consistently bond tow such that consistent pressure drops between opposing ends of the filter elements can be achieved. Accordingly, embodiments of the present disclosure may be employed in conjunction with traditional filter tow materials such as cellulose acetate in some embodiments.

Further, the system 300 can include a cigarette maker 360 that attaches a smokable rod formed from smokable material 362 wrapped with wrapping material 364 to the filter element 358 via tipping material 366. Exemplary embodiments of machines that may be employed as the cigarette maker 360 include machines commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; U.S. Pat. No. 6,904,917 to Kitao et al.; U.S. Pat. No. 7,210,486 to Hartmann; U.S. Pat. No. 7,234,471 to Fitzgerald et al.; U.S. Pat. No. 7,275,548 to Hancock et al.; and U.S. Pat. No. 7,281,540 to Barnes et al.; each of which is incorporated herein by reference.

The cigarettes 368 formed by the cigarette maker 360 can exhibit a desirable resistance to draw. For example, an exemplary cigarette 368 can exhibit a pressure drop of between about 50 mm and about 200 mm water pressure drop at 17.5 cc/sec. air flow. Other preferred cigarettes exhibit pressure drop values of between about 70 mm and about 180 mm, more preferably between about 80 mm to about 150 mm water pressure drop at 17.5 cc/sec. air flow. In this regard, the pressure drop of the filter element 358 can combine with an additional pressure drop associated with the tobacco rod, to produce an overall pressure drop associated with the cigarettes 368. Since the pressure drop associated with the filter element 358 can be more relatively more precisely controlled in accordance with embodiments of the present disclosure, the overall pressure drop associated with the cigarettes 368 can also be relatively more precisely controlled to achieve a desired pressure drop across the cigarettes.

Further, in some embodiments the system 300 can include an additional component applicator 370 configured to add an additional component 372 during formation of the cigarettes 368. In some embodiments, the additional component applicator 370 can comprise a plasticizer applicator. In this regard, as noted above, plasticizers can provide desirable sensory qualities such as desirable taste. However, the plasticizer applicator can be configured to apply relatively less plasticizer than is traditionally employed to bond filter tow, because the ultrasonic bonder 341 can be employed to bond the bloomed tow 338. The additional component applicator 370 can be configured to additionally or alternatively add any other additional component configured to contribute some functionality or property, such as, for example, smoke filtering, smoke taste, water dispersibility, biodegradability, and/or compostability.

The additional component applicator 370 can add the additional component 372 to the bonded bloomed tow 349 (as illustrated by arrow 374), to the filter element 358 (as illustrated by arrow 376), or to the completed cigarettes 368 (as illustrated by arrow 378). However, as noted above, in other embodiments the additional component can be additionally or alternatively applied by the system 300 at any other point during the production of the cigarettes. Accordingly, the system for forming cigarettes 300 can include various apparatuses that perform the operations described above with respect to FIG. 2 to form cigarettes 368.

Embodiments of related methods are also provided. In this regard, FIG. 6 illustrates an example embodiment of a method for forming a filter element (e.g., a cigarette filter element). As illustrated, the method may include blooming a tow defining a plurality of fibers of a filter material to define a bloomed tow at operation 500. In some embodiments the filter material can comprise polylactic acid or cellulose acetate, although various other filter materials can be employed in other embodiments. Additionally, the method can include ultrasonically bonding the fibers of the filter material defining the bloomed tow to form a bonded bloomed tow at operation 502. In some embodiments, ultrasonically bonding the fibers of the filter material at operation 502 can comprise directing the bloomed tow between an anvil and a sonotrode. Also, ultrasonically bonding the fibers of the filter material at operation 502 can include bonding the fibers of the filter material defining the bloomed tow in a pattern configured to bond the fibers to a degree that defines a selected pressure drop between opposing ends of the filter element and/or a selected firmness. In some embodiments ultrasonically boding the fibers of the filter material can comprise vibrating the fibers of the filter material at a frequency of between about 20 kilohertz and about 35 kilohertz and/or vibrating the fibers of the filter material at a peak power level of between about 600 watts and about 4,000 watts.

The method may further comprise wrapping the bonded bloomed tow with a plug wrap, which may be conducted after ultrasonically bonding the fibers of the filter material at operation 502. Also, the method may further comprise applying an additional component to the bonded bloomed tow. By way of example, the additional component may comprise a plasticizer, such as triacetin in some embodiments. The additional component may be applied before or after any of the above-described operations.

Embodiments of tobacco products that may be produced using the above described apparatuses, systems, and/or methods are also provided. In this regard, by way of example, FIG. 7 illustrates an exploded view of a smoking article in the form of a cigarette 600 that may be produced by the apparatuses, systems, and methods disclosed herein. The cigarette 600 (or other embodiment of a tobacco product) can include a tobacco material, which may be embodied as a generally cylindrical rod 612. A wrapping material 616 may extend at least partially about the tobacco material. The rod 612 is conventionally referred to as a "tobacco rod." The ends of the tobacco rod 612 are open to expose the smokable filler material. The cigarette 600 is shown as having one optional band 622 (e.g., a printed coating including a film-forming agent, such as starch, ethylcellulose, or sodium alginate) applied to the wrapping material 616, and that band circumscribes the tobacco rod 612 in a direction transverse to the longitudinal axis of the cigarette 600. That is, the band 622 provides a cross-directional region relative to the longitudinal axis of the cigarette 600. The band 622 can be printed on the inner surface of the wrapping material 616 (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 612 is the lighting end 618, and at the mouth end 620 is positioned a filter element comprising a bonded bloomed tow 626. In one embodiment the bonded bloomed tow 626 may comprise polylactic acid or cellulose acetate, although various other filter materials may be employed in other embodiments. The bonded bloomed tow can be formed in accordance with the above-described operations. For example, the bonded bloomed tow 626 can be formed by providing a plurality of fibers of a filter material defining a tow, blooming the tow to define a bloomed tow, and ultrasonically bonding the fibers of the filter material defining the bloomed tow. Further, in some embodiments the fibers of the filter material defining the bloomed tow can be bonded in a pattern configured to bond the fibers to a degree that defines a selected pressure drop between opposed ends of the filter element and/or a selected firmness. Additionally, the bonded bloomed tow 626 may define a desired firmness. In some embodiments the bonded bloomed tow 626 may include an additional component. For example, the bonded bloomed tow 626 can include a plasticizer such as triacetin.

The bonded bloomed tow 626 can have a generally cylindrical shape, and the diameter thereof may be essentially equal to the diameter of the tobacco rod 612. The filter element can further include a layer of outer plug wrap 628 that circumscribes and extends at least partially about the bonded bloomed tow 626. The filter element is positioned adjacent one end of the tobacco rod 612 such that the filter element and tobacco rod 612 are axially aligned in an end-to-end relationship, preferably abutting one another. The ends of the filter element thus permit the passage of air and smoke therethrough.

The bonded bloomed tow 626 may be attached to the tobacco rod 612 using a tipping material 640 (e.g., essentially air impermeable tipping material), that can circumscribe and extend at least partially along the filter element and an adjacent region of the tobacco rod 612. The tipping material 640 may be substantially air impermeable, or include perforations 630 that may also extend through the plug wrap 628. The inner surface of the tipping material 640 is fixedly secured to the outer surface of the plug wrap 628 and the outer surface of the wrapping material 616 of the tobacco rod, using a suitable adhesive; and hence, the filter element and the tobacco rod are connected to one another to form the cigarette 600.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for filter element forming, comprising:

spreading a tow including a plurality of fibers of a filter material to define a bloomed tow having the fibers arranged in a flattened configuration, each of the fibers of the bloomed tow consisting of polylactic acid;

ultrasonically vibrating the fibers of the filter material defining the bloomed tow to heat and fuse the fibers at a plurality of discrete locations and form a bonded bloomed tow having the fibers arranged in the flattened configuration; and forming the bonded bloomed tow into a filter element for a smoking article by shaping the bonded bloomed tow having the fibers arranged in the flattened configuration into a cylindrical rod.

2. The method of claim 1, further comprising wrapping the bonded bloomed tow with a plug wrap.

3. The method of claim 1, further comprising applying a plasticizer to the bonded bloomed tow.

4. The method of claim 3, wherein applying the plasticizer comprises applying triacetin to the bonded bloomed tow.

5. The method of claim 1, wherein ultrasonically vibrating the fibers of the filter material comprises vibrating the fibers of the filter material at a frequency of between about 20 kilohertz and about 35 kilohertz.

6. The method of claim 1, wherein ultrasonically vibrating the fibers of the filter material comprises vibrating the fibers of the filter material at a peak power level of between about 600 watts and about 4,000 watts.

7. The method of claim 1, wherein ultrasonically vibrating the fibers of the filter material comprises directing the bloomed tow between an anvil and a sonotrode.

8. The method of claim 1, wherein ultrasonically vibrating the fibers of the filter material comprises ultrasonically vibrating the fibers of the filter material defining the bloomed tow in a pattern configured to bond the fibers to a degree that defines a selected pressure drop between opposing ends of the filter element.

9. A smoking article filter element, comprising:

a plurality of fibers of a filter material spread to define a bloomed tow having the fibers arranged in a flattened configuration, each of the fibers of the bloomed tow consisting of polylactic acid, and ultrasonically vibrated when configured as the bloomed tow to heat and fuse the fibers at a plurality of discrete locations and form a bonded bloomed tow having the fibers arranged in the flattened configuration, the bonded bloomed tow being formed into a filter element for a smoking article by shaping the bonded bloomed tow having the fibers arranged in the flattened configuration into a cylindrical rod.

10. The filter element of claim 9, further comprising a plasticizer.

11. The filter element of claim 10, wherein the plasticizer comprises triacetin.

12. The filter element of claim 9, wherein the filter element defines a firmness from about 1% to about 10%.

13. The filter element of claim 9, wherein the fibers of the filter material defining the bloomed tow are ultrasonically bonded in a pattern configured to bond the fibers to a degree that defines a selected pressure drop between opposing ends of the filter element.

14. A tobacco product, comprising:

a tobacco material;

a filter element, comprising a plurality of fibers of a filter material spread to define a bloomed tow having the fibers arranged in a flattened configuration, each of the fibers of the bloomed tow consisting of polylactic acid, and ultrasonically vibrated to heat and fuse the fibers of the bloomed tow at a plurality of discrete locations and form a bonded bloomed tow having the fibers arranged in the flattened configuration, the bonded bloomed tow having the fibers arranged in the flattened configuration being shaped into a cylindrical rod; and a tipping material extending at least partially about the tobacco material and the filter element.

15. The tobacco product of claim 14, further comprising a wrapping material extending at least partially about the tobacco material.

16. The tobacco product of claim 15, further comprising a plug wrap extending at least partially about the bonded bloomed tow.

17. The tobacco product of claim 14, further comprising a plasticizer.

18. The tobacco product of claim 17, wherein the plasticizer comprises triacetin.

19. The tobacco product of claim 14, wherein the fibers of the filter material defining the bloomed tow are bonded in a pattern configured to bond the fibers to a degree that defines a selected pressure drop between opposing ends of the filter element.

* * * * *